US010633723B2

(12) United States Patent
Braydich et al.

(10) Patent No.: US 10,633,723 B2
(45) **Date of Patent: *Apr. 28, 2020**

(54) MULTI-PHASE COVETIC AND METHODS OF SYNTHESIS THEREOF

(71) Applicant: GDC Industries, LLC, Dayton, OH (US)

(72) Inventors: Michael Dennis Braydich, Beavercreek, OH (US); Harry Couch, Beavercreek, OH (US); Louis A. Luedtke, Centerville, OH (US)

(73) Assignee: GDC Industries, LLC, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/126,166

(22) Filed: Sep. 10, 2018

(65) Prior Publication Data

US 2019/0256952 A1 Aug. 22, 2019

Related U.S. Application Data

(62) Division of application No. 15/484,595, filed on Apr. 11, 2017, now Pat. No. 10,072,319.

(Continued)

(51) Int. Cl.
*C22C 1/02* (2006.01)
*C22C 1/10* (2006.01)

(Continued)

(52) U.S. Cl.
CPC ..... *C22C 1/026* (2013.01); *C22C 1/02* (2013.01); *C22C 1/1036* (2013.01); *C22C 21/00* (2013.01);

(Continued)

(58) Field of Classification Search
None
See application file for complete search history.

(56) References Cited

U.S. PATENT DOCUMENTS 7,468,088 B1 * 12/2008 Blankenhorn ..... C22B 21/06 75/10.18
8,349,759 B2 * 1/2013 Shugart ..... C22C 5/02 502/184

(Continued)

FOREIGN PATENT DOCUMENTS

WO 2017/180641 A2 10/2017

OTHER PUBLICATIONS

Salamanca-Riba, L. et al. "Synthetic crystals of silver with carbon: 3d epitaxy of carbon nanostructures in the silver lattice." 2015. Advanced functional materials. 25. p. 4768-4777 (Year: 2015).*

(Continued)

*Primary Examiner* — Christopher S Kessler
*Assistant Examiner* — Nicholas A Wang
(74) *Attorney, Agent, or Firm* — Wood IP LLC

(57) ABSTRACT

There are provided methods and systems for creating multi-phase covetics. For example, there is provided a process for making a composite material. The process includes forming a multi-phase covetic. The forming includes heating a melt including a metal in a molten state and a carbon source to a first temperature threshold to form metal-carbon bonds. The forming further includes subsequently heating the melt to a second temperature threshold, the second temperature threshold being greater than the first temperature threshold. The second temperature threshold is a temperature at or above which ordered multi-phase covetics form in the melt.

8 Claims, 5 Drawing Sheets

Related U.S. Application Data

(60) Provisional application No. 62/321,192, filed on Apr. 11, 2016, provisional application No. 62/410,705, filed on Oct. 20, 2016.

(51) Int. Cl.
*C22C 26/00* (2006.01)
*C22C 21/00* (2006.01)

(52) U.S. Cl.
CPC ..... *C22C 26/00* (2013.01); *C22C 2026/001* (2013.01); *C22C 2026/002* (2013.01)

(56) References Cited

U.S. PATENT DOCUMENTS

| | | | |
|---|---|---|---|
| 8,541,335 | B2 | 9/2013 | Shugart et al. |
| 8,541,336 | B2 | 9/2013 | Shugart et al. |
| 8,551,905 | B2 | 10/2013 | Shugart et al. |
| 8,647,534 | B2 | 2/2014 | Shugart et al. |
| 10,072,319 | B2 | 9/2018 | Braydich et al. |
| 2010/0327233 | A1 | 12/2010 | Shugart et al. |
| 2012/0009110 | A1 | 1/2012 | Shugart et al. |
| 2012/0244033 | A1 | 9/2012 | Shugart et al. |
| 2013/0048906 | A1 | 2/2013 | Shugart et al. |

OTHER PUBLICATIONS

Knych, T. et al. "Characterization of nanocarbon copper composites manufactured in metallurgical synthesis process." 2014. Metallurgical and materials transactions B. 45B. p. 1196-1203. (Year: 2014).*

Isaacs, et. al., Applied Physics Letters, 106, (2015), 193108-1, 6 pages.

Salamanca-Riba, et. al., "Synthetic Crystals of Silver with Carbon: 3D Epitaxy of Carbon Nanostructures in the Silver Lattice," Advanced Functional Materials, vol. 25, Issue 30, Aug. 12, 2015, pp. 4768-4777.

Jaim, et. al., "Sp2 Carbon Embedded in Al-6061 and Al-7075 Alloys in the Form of Crystalline Graphene Nanoribbons," Carbon, 107 (2016), pp. 56-66.

Brown, L., et. al., "Physical and Mechanical Characterization of a Nanocarbon Infused Aluminum-Matrix Composite," Materials Performance and Characterization, vol. 3, No. 1, 2014, pp. 65-80.

Gavillet, J., et. al., "Nucleation and Growth of Single-Walled Nanotubes: The Role of Metallic Catalysts," Journal of Nanoscience and Nanotechnolgy, vol. 4, No. 4, 2004, pp. 346-359.

Amini, S., et. al., "Growth of Large-Area Graphene Films From Metal-Carbon Melts," Journal of Applied Physics 108, 094321, 2010, 7 pages.

Bakir, M. et al., "Novel Metal-Carbon Nanomaterials: A Review on Covetics," Department of Mechanical Science and Engineering, University of Illinois at Urbana-Champaign, 2016, pp. 1-8.

Jaim, et. al., "Characterization of Carbon Nanostructures in Al and Ag Covetic Alloys," Carbon, 111 (2017), pp. 309-321.

Wood, Terry, Final Report on Thermal Properties Measurements of a Covetic Cu/C Composite for McKean Defense Group, LLC, EMTL Final Report No. 266, Energy Materials Testing Laboratory, Nov. 23, 2011, 19 pages.

GDC Industries, "Covetic Conversion Process," Fourth Covetic Workshop, Oak Ridge National Laboratory, Apr. 28, 2016, 17 pages.

Shenjia Zhang, Ph.D., General Cable—Indianapolis Technology Center, "Covetic Aluminum Conductor," 18 pages.

Paul D. Jablonski et al., "Microstructure and Mechanical Property Report on Covetic Materials," National Energy Technology Laboratory, Covetic Meeting Apr. 2017, 38 pages.

J. (Balu) Balachandran, "Covetic Materials R&D*," Argonne National Laboratory, Presentation at Covetics Workshop, Oak Ridge TN, Apr. 27-28, 2017, 41 pages.

David R. Forrest, ScD, PE, FASM, "AMD's Program in Covetic Nanomaterials," Dept. of Energy, Advanced Manufacturing Office, Fourth Covetics Workshop, Oak Ridge, TN, Apr. 27, 2017, 18 pages.

Salamanca-Riba et al., "A New Type of Carbon Nanostructure Formed Within a Metal-Matrix", Maryland University College Park,Presented at Tech Connect World, 2012, 5 Pages.

International Search Report and Written Opinion Received for PCT Patent Application PCT/US2017/027034, dated Oct. 12, 2017, 7 Pages.

Yolshina et al., Novel Lead-Graphene and Lead-Graphite Metallic Composite Materials for Negative Electrode Grid of Lead-Acid Battery, Institute of High-Temperature Electrochemistry, 4 pages.

Lourdes Salamanca-Riba et al., GDC Industries, "Covetics at the University of Maryland," Covetics Workshop, Apr. 27, 2017, 31 pages.

Iwona Jasiuk et al., GDC Industries, "UIUC Update on Covetics: Characterization and Modeling of Aluminum and Copper Covetics," Department of Mechanical Science and Engineering University of Illinois at Urbana-Champaign (UIUC), Covetics Workshop, Apr. 27, 2017, 56 pages.

Knych, T. et al., "Characterization of Nanocarbon Copper Copmosites Manufactured in Metallurgical Synthesis Process," 2014, Metallurgical and Materials TransactionsB. 45B. p. 1196-1204 (Year: 2014).

Salamanca-Riba, L. et al., "The Incorporation of C in the Crystal Lattice of Metals: It's Role on the Structure and Properties of these New Materials called Covetics," 2013, American Physical Society March meeting, Mar. 18-22, 2013, Abstract (Year: 2013).

* cited by examiner

MULTI-PHASE COVETIC AND METHODS OF SYNTHESIS THEREOF

CROSS-REFERENCE TO RELATED APPLICATIONS

This application is a Divisional of U.S. patent application Ser. No. 15,484,595, filed Apr. 11, 2017, which will issue as U.S. Pat. No. 10,072,319 on Sep. 11, 2018, which claims the benefit of U.S. Provisional Patent Application No. 62/321,192, filed on Apr. 11, 2016 and U.S. Provisional Patent Application No. 62/410,705, filed on Oct. 20, 2016, all of which are incorporated herein in its entirety by reference.

STATEMENT REGARDING GOVERNMENT RESEARCH AND DEVELOPMENT

This invention was made with Government support under Grant Number: DE-SC0015256 awarded by the U.S. Department of Energy. The Government has certain rights in this invention.

TECHNICAL FIELD

The present disclosure relates to covetics. More particularly, the present disclosure relates to multi-phase covetics and their methods of synthesis.

BACKGROUND

The advent of nanocarbons (e.g., graphene, fullerenes, and nanotubes) has generated a renewed interest in the metal industry to create new metal alloys that incorporate these forms of carbon. Nanocarbons have significantly improved properties (e.g., strength, thermal conductivity, or electrical conductivity) over traditional carbon forms such as carbon black, activated carbon, carbon fibers, or graphite. As such, their successful inclusion into metal matrices is poised to create alloys having enhanced properties with respect to the properties of the host metals.

Such alloys are called covetics, a relatively new class of metal-carbon composites, and they have been shown to include $sp^3$ carbon domains in a metal matrix. However, several difficulties exist in synthesizing covetics, thus impeding their widespread use in a wide variety of applications. One such difficulty is that carbon is inherently insoluble in metal because it repels metal atoms. This means that carbon surfaces cannot be wetted by the liquid metal during the covetics forming process, and very few metal-carbon domains are formed in the metal matrix of a typical covetic. Moreover, these domains are randomly distributed over the metal matrix. Another difficulty is the creation of metal carbides that can degrade the property of the composite.

To circumvent these issues, nanocarbons are typically formed externally from the liquid metal and incorporation of the nanocarbons in the metal matrix is then attempted. However, for most metals having relevant industrial use, such as transition metals, the high temperatures needed to melt the metal to create the liquid metal leads to the unwanted decomposition of the pre-made nanocarbons. As such, there is a need for forming nanocarbons in-situ, i.e. during the alloying process, by starting from a non-nanocarbon source.

SUMMARY

The embodiments featured herein help solve or mitigate the above noted issues as well as other issues known in the art. For instance, the embodiments provide methods for making multi-phase covetics that include highly-ordered networks of nanocarbons covalently bonded to the surrounding metal matrix. The embodiments provide means for producing a multi-phase covetic that has properties that are enhanced with respect to the same properties in the base materials of the multi-phase covetic (i.e., in the metal and in the non-nanocarbon source).

For instance, an exemplary multi-phase covetic can have thermal conductivity that is about 50% higher than the thermal conductivity of the base metal included in the multi-phase covetic. In yet other embodiments, the exemplary multi-phase covetic can have electrical conductivity that is about 50% higher than the electrical conductivity of the base metal included in the multi-phase covetic.

One embodiment provides a process for making a composite material. The process includes forming a multi-phase covetic. The process includes forming a multi-phase covetic. The forming includes heating a melt including a metal in a molten state and a carbon source to a first temperature threshold to form metal-carbon bonds. The forming further includes subsequently heating the melt to a second temperature threshold, the second temperature threshold being greater than the first temperature threshold. The second temperature threshold is a temperature at or above which ordered multi-phase covetics form in the melt.

Another embodiment provides a process for making a composite material. The process includes forming covalent bonds between carbon and a metal to form a multi-phase covetic. Forming the covalent bonds can be achieved by energizing a melt that includes a carbon source and a molten metal. Subsequent to forming the covalent bonds, the process can include forming an ordered network of carbon atoms in the multi-phase covetic by further energizing the melt above a threshold at which forming the covalent bonds occurred.

Another embodiment provides a composite material that includes a multi-phase covetic. The multi-phase covetic can include a nanocarbon network in which carbon atoms form covalent bonds with a metal matrix and in which the nanocarbon network is an ordered network of carbon atoms.

Additional features, advantages, and other aspects of various embodiments are described below with reference to the accompanying drawings. It is noted that the present disclosure is not limited to the specific embodiments described herein. These embodiments are presented for illustrative purposes. Additional embodiments, or modifications of the embodiments disclosed, will be readily apparent to persons skilled in the relevant art(s) based on the teachings provided.

BRIEF DESCRIPTION OF THE DRAWINGS

Illustrative embodiments are shown in the accompanying drawings, throughout which like reference numerals may indicate corresponding or similar parts in the various drawings. The drawings are for purposes of illustrating the embodiments and are not to be construed as limiting the disclosure. Given the following enabling description of the drawings, the novel aspects of the present disclosure should become evident to a person of ordinary skill in the relevant art(s).

DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

Figure 1:
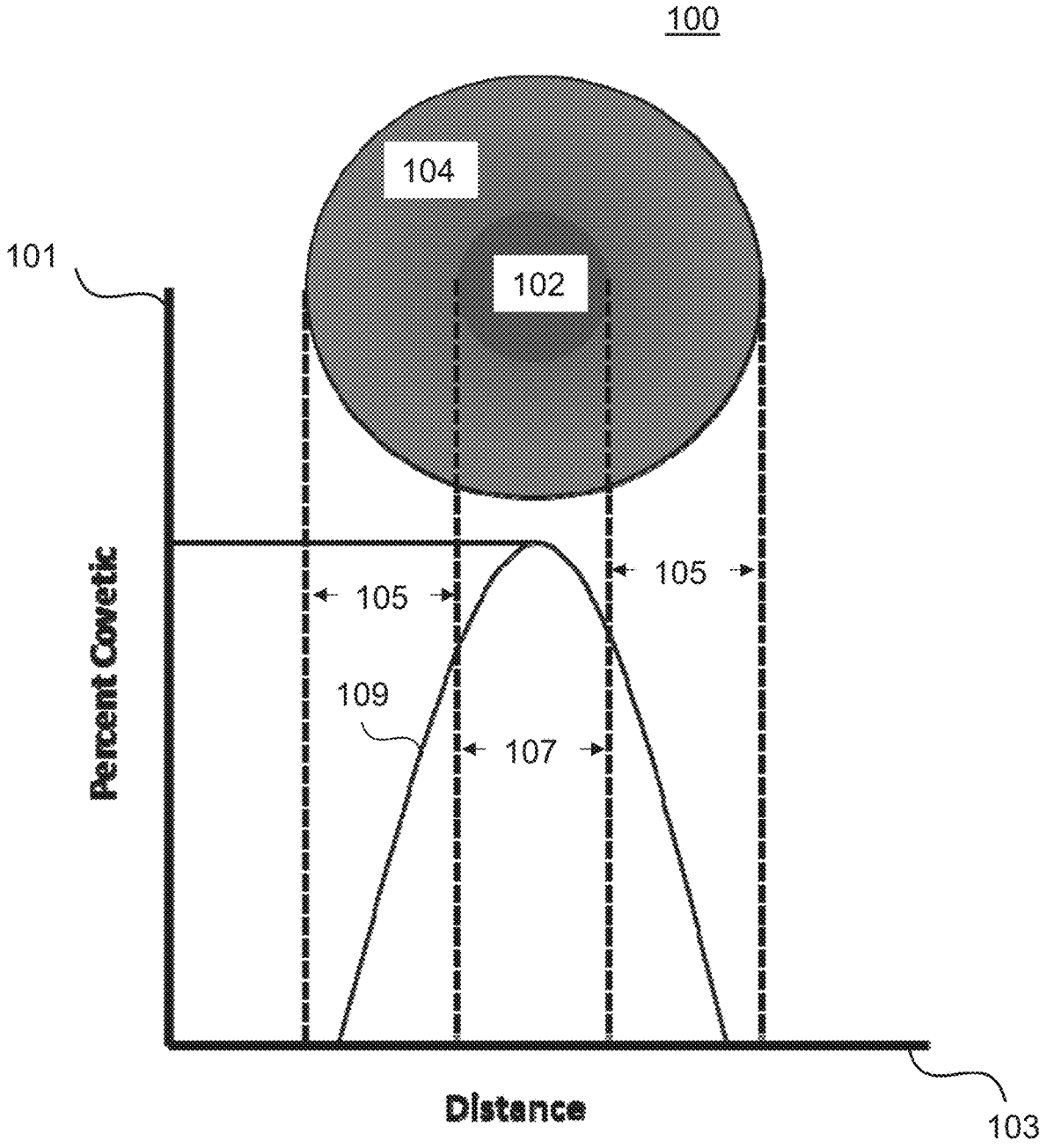
FIG. 1 illustrates a multi-phase covetic according to an embodiment.

FIG. 1 shows a cross-sectional view of a multi-phase covetic 100 according to an embodiment. The exemplary multi-phase covetic 100 is a composite material, and it includes an inner region 102 and an outer region 104. The inner region 102 is a region in which the structure of the composite material is substantially made of a covetic phase characterized by carbon atoms covalently bonded to the surrounding metal matrix. Conversely, the outer region 104 is substantially made of metal. Nevertheless, as shall be described below, the outer region 104 can include some covetic domains.

The multi-phase covetic 100 is shown against a set of axes (101 and 103) in order to illustrate exemplary relative spatial distributions of the covetic phase versus that of the metal phase within the multi-phase covetic 100. As illustrated by the trace 109, the inner region 102 (having a width 107) is substantially a covetic, with the maximum concentration the covetic structure at the center of the inner region 102. In contrast, farther away from the center of the inner region 102, the structure is substantially of a non-covetic phase as exemplified by the trace 109 with respect to the sections of the outer region 104 having widths 105.

Figure 2A:
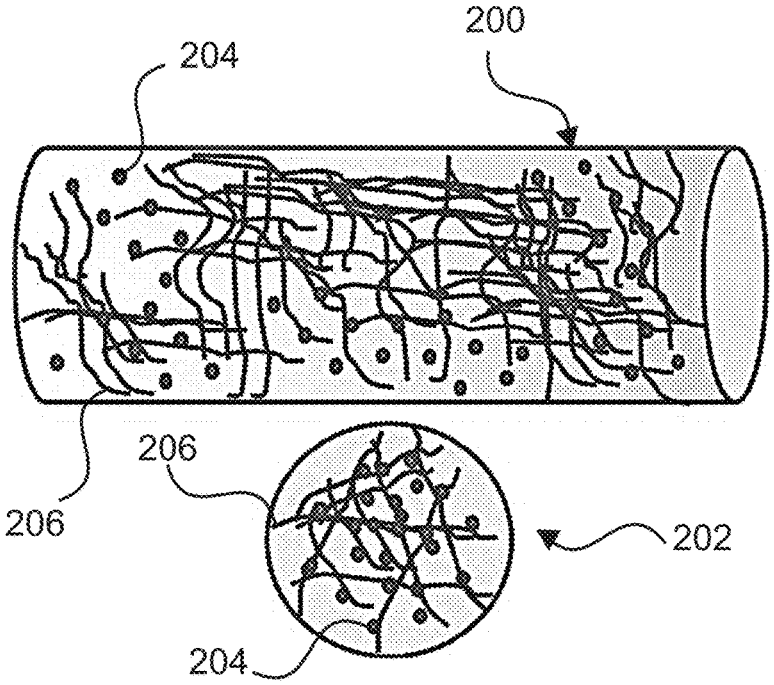
FIG. 2A illustrates a view of a multi-phase covetic according to an embodiment.
Figure 2B:
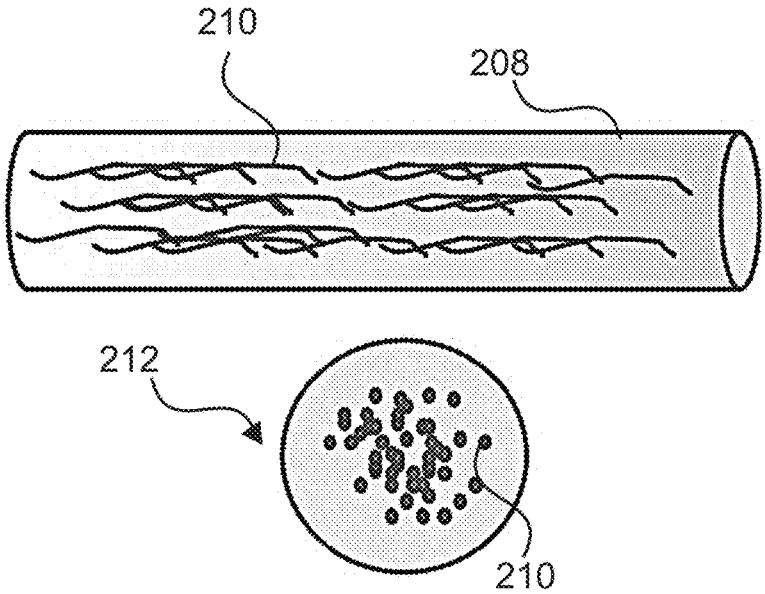
FIG. 2B illustrates a view of a multi-phase covetic according to an embodiment.

FIGS. 2A and 2B illustrate views of multi-phase covetics, according to exemplary embodiments. FIG. 2A shows a side view of a multi-phase covetic 200 that includes ordered carbon atoms in lamellar structures disposed in a random pattern. Some of the structures are oriented in a direction 206 whereas others are oriented in a direction 204. The view 202 is a cross-sectional view of the multi-phase covetic 200 showing the random pattern made by the carbon atoms within the metal matrix, which, together, form the multi-phase covetic 200. The multi-phase covetic 200 can be a covetic that is obtained as-cast from an exemplary synthesis process that shall be described in further detail below.

FIG. 2B shows a side view of a multi-phase covetic 208 obtained from aforementioned exemplary synthesis process but where the process includes an extrusion step of the as-cast covetic. As shown in FIG. 2, the multi-phase covetic 208 includes a plurality of carbon atoms that form a highly ordered nanocarbon network in which carbon is covalently bonded to the metal matrix. Moreover, a substantial amount of carbon structures are oriented in the same direction 210, as shown in the side view of the multi-phase covetic 208 and in the cross-sectional view 212.

Having set forth several exemplary structural embodiments of multi-phase covetics, methods of synthesis capable of yielding such covetics, as well as the apparatus for their synthesis, are described below with respects to FIGS. 3-5. Without limitation, in the contemplated synthesis methods, the metal can be copper, gold, aluminum, or silver. Generally, the metal can be a transition metal. On the other hand, the carbon can be selected from a plurality of carbon sources. For example, without limitation, the carbon can originate from graphite or exfoliated graphite or from a nanocarbon oxide.

One exemplary synthesis process for forming a composite material based on a multi-phase covetic such as the ones described above can include heating a melt comprising molten metal and carbon to about a first temperature threshold. In general terms, the first temperature threshold can be substantially greater than a second temperature threshold, as described below.

The second temperature threshold can be covetic reaction temperature threshold, which is a temperature below which a covetic reaction does not occur. For example, when the metal is copper, the molten metal can be created at by melting copper in furnace (or melting pot) at its melting temperature, namely about 1984 degrees Fahrenheit. When the carbon is added into the melt its temperature must be raised by at least 500 degrees Fahrenheit to form carbon-copper covetic domains. In other words, without this additional increase in temperature, and without crossing that reaction temperature threshold, no carbon-copper covetic domains can be formed, and substantially all of the carbon introduced into the molten metal will remain unreacted.

In the related art, covetic reactions have been shown to occur at a temperature above the metal's melting point but at the covetic reaction threshold. However, it was not known how to form highly ordered multi-phase covetics that includes a first phase of highly ordered nanocarbon covetics comprising carbon atoms that are covalently bonded to their surrounding metal matrix and a second phase of unreacted metal. The embodiments set forth herein bridge this gap and provide means for creating multi-phase covetics by creating highly ordered nanocarbon domains in-situ.

In the exemplary process disclosed above, raising the temperature of the melt (i.e. the molten metal and the carbon) substantially above the covetic reaction temperature threshold causes highly ordered nanocarbons to be formed, as opposed to randomly dispersed carbon-metal domains that are not nanocarbons. For instance, in the aforementioned example of a carbon-copper covetic, the temperature of the melt can be raised to a critical temperature of about 1830 degrees Fahrenheit (above the melting point of copper) to create the highly ordered nanocarbon networks described above. This critical temperature substantially exceeds the covetic reaction temperature threshold of 500 degrees Fahrenheit above the melting point of copper, the covetic reaction temperature threshold being the temperature threshold below which no copper-carbon covetic can be formed.

Figure 3:
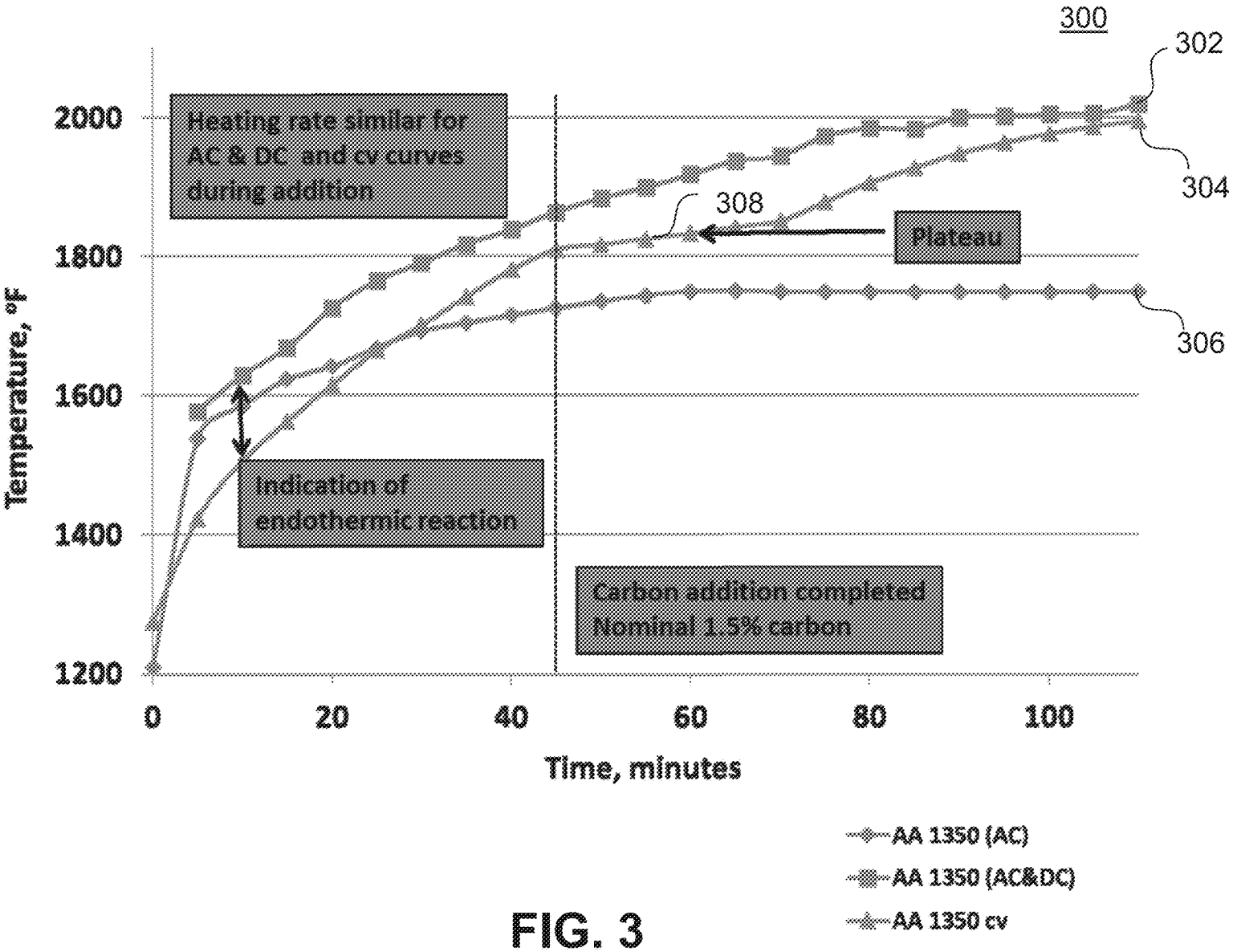
FIG. 3 depicts a temperature chart characteristic of a synthesis process of a multi-phase covetic according to an embodiment.

FIG. 3 illustrates a reaction chart 300 for the exemplary process described above, i.e. for a copper-carbon covetic. Temperature is shown on the y-axis as being the relative temperature increase above the melting point of the metal. The x-axis shows the reaction time. The trace 302 represents the temperature of the melt as temperature is increased but no carbon is added. The trace 304, on the other hand, represents the temperature of the melt when carbon is added into the molten metal.

As shown from the trace 304, the heat profile changes slope to form a plateau 308 and then regains its original slope to coincide with the trace 302. The trace 304, being shifted from the trace 302 downward, indicates that the covetic reaction is endothermic. More importantly, however, the plateau 308 is formed at a critical temperature of about 1832 degrees Fahrenheit. The plateau 308 is the region in the heat profile curve at which point highly ordered nanocarbons are formed to yield a multi-phase covetic. In other words, the plateau 308 coincides with the critical temperature at which the formation of sp2 carbon is maximized.

As has been experimentally confirmed by the inventors, samples for which the plateau was not reached did not yield the described multi-phase covetics described herein, but rather covetic structures characterized by sp3 carbon and having randomly distributed copper-metal domains with significantly few nanocarbon structures. The trace 306 represents the heat profile when a multi-phase covetic is melted. As shown by the trace 306, the profile does not coincide with either the trace 304 or the trace 302, which suggest that the covetic does not phase-separate when molten.

Following the formation of the multi-phase covetic described above, the melt can be cast and let to cool to obtain a solid sample. The as-cast sample can then be extruded to further promote segregation between the two phases as shown in FIG. 2B.

Generally, an exemplary process of forming a multi-phase covetics includes two different threshold temperatures. The first threshold temperature is the minimum temperature required for the covetic reaction to occur, i.e. for metal-carbon bonds to form a covetic. In some embodiments, the first temperature threshold may be about 500 degrees Fahrenheit. Consequently, metals with melting points well below 500 degrees Fahrenheit will not undergo covetic conversion unless their temperature is raised to about 500 degrees Fahrenheit.

One such metal is Gallium, which melts at about 86 degrees Fahrenheit. This means that Gallium would not convert to a covetic, even when its temperature is raised just above its melting point. Moreover, alkali metals (lithium through cesium) all melt below about 360 degrees Fahrenheit. As such, to effect a conversion in these metals, the minimum first threshold temperature of about 500 degrees Fahrenheit must also be reached.

The second temperature threshold, which is higher than the first temperature threshold, is the temperature at which highly-ordered multi-phase covetic domains are formed. In other words, a covetic is formed after reaching the first temperature threshold, but that covetic is not highly ordered. Specifically, it is filled with defects from the carbon source even though the metal-carbon bonds are formed.

Conversely, at the second temperature threshold, there is sufficient energy (thermal and electrical) to cause the rearrangement of the covetic carbon to form $sp^2$ bonds from the defective $sp^3$ bonds formed at the first temperature threshold. The $sp^2$ bonds eventually rearrange to form a highly stable nanocarbon structure that gives rise to the property enhancements associated with multi-phase covetics.

In some embodiments, the second temperature threshold can be about 1832 degrees Fahrenheit, and Aluminum is one example metal that can illustrate the above-described chemistry. As shown in FIG. 3, for multi-phase covetic materials that includes aluminum and activated carbon, formation of highly ordered multi-phase covetics are maximized at 1832 degrees Fahrenheit, i.e., at the second temperature threshold.

Metals with melting points higher than the second temperature threshold of 1832 degrees Fahrenheit, such as iron, copper, silver, would solidify if their melts were reduced to the second temperature threshold. As such, the conversion process (to highly ordered multi-phase covetics) does not come to completion until over 4500 degrees Fahrenheit. However, for these metals, the conversion of highly ordered carbons is already taking place when the metal-carbon bonds are first formed.

To ensure sufficient conversion to highly ordered carbons, the reaction must continue well beyond the point at which all the carbon required for the reaction has been added. The actual time to continue the run varies based on how much carbon is added. As a general rule, one can extend the reaction for an additional period of time equivalent to the time it requires to add the carbon source.

While the exemplary process for synthesizing the multi-phase covetic has been described above with temperature being a critical parameter, other parameters can also influence and promote the formation of the multi-phase covetics described herein. For example, energizing the melt with an electrical current and shear-mixing the melt during the process contributes to providing higher degrees (i.e. high concentrations) of the nanocarbon network in the resulting multi-phase covetic. These additional process factors are described below in more detail in the context of an exemplary synthesis system or apparatus for making the exemplary multi-phase covetics.

Figure 4:
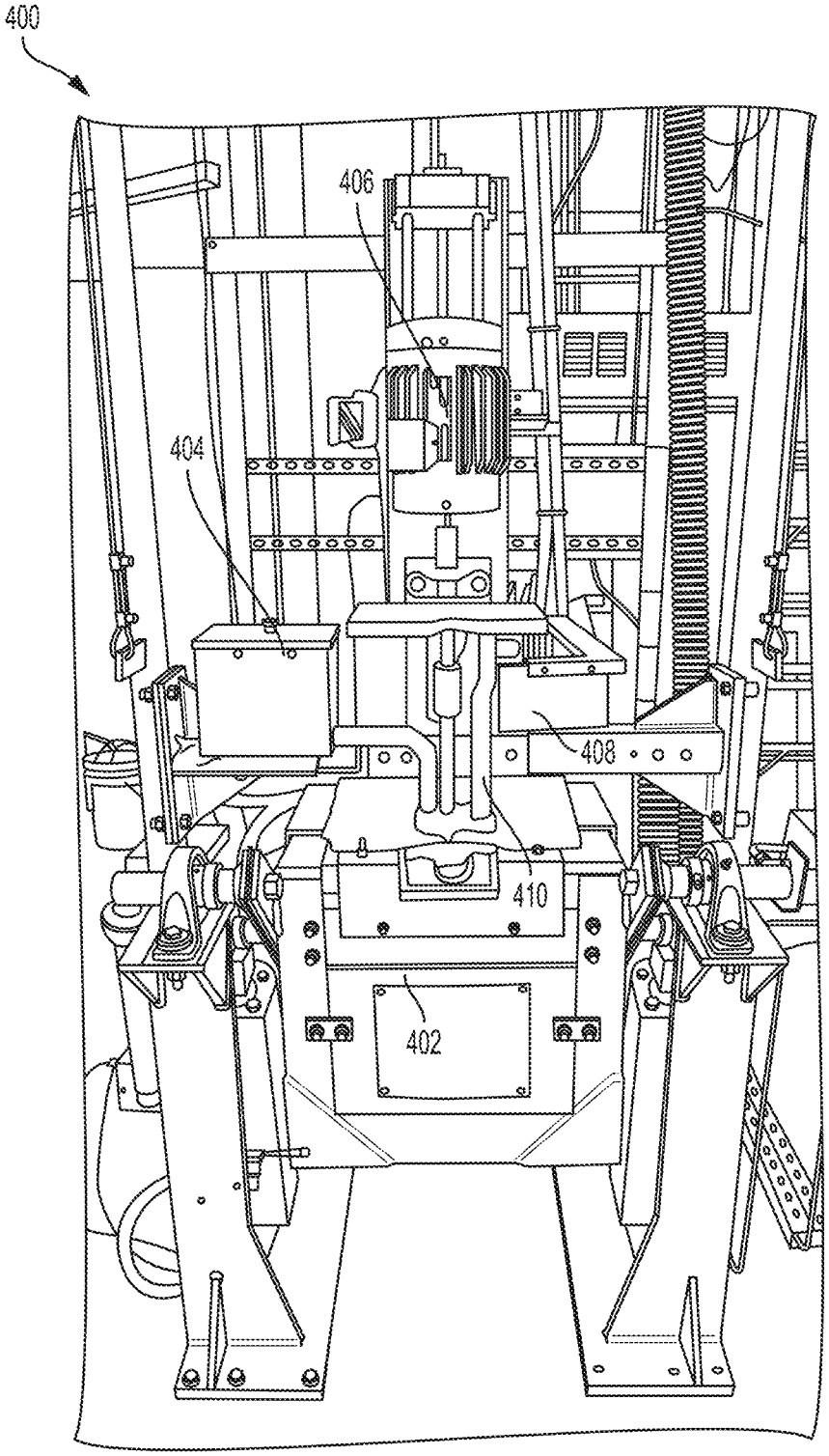
FIG. 4 depicts a system for synthesizing a multi-phase covetic according to an embodiment.

FIG. 4 illustrates an apparatus or system 400 for synthesizing a multi-phase covetic, such as the ones described above and throughout this disclosure. The system 400 can be used for experimental purposes or for manufacturing. For large scale application, the system 400 can be sized appropriately to accommodate a predetermined material yield.

Further, while a specific arrangement of components is shown in FIG. 4, one of skill in the art will readily recognized that other arrangements of components can be used to yield the same effects and advantages as those described herein. Furthermore, while specific hardware are described for performing specific functions, other hardware that can achieve the same functions can also be used without departing from the scope of the present disclosure.

The exemplary system 400 includes a melting pot 402 in which can be introduced pellets of a metal that is to be used to form a composite material. The melting pot 402 can include integrated heaters capable of setting a temperature in an inner chamber of the melting pot 402 in order to drive reactions occurring therein. Furthermore, the melting pot 402 can be interfaced with a plurality of sensors that are capable of monitoring a status the reaction occurring inside the melting pot 402. Such sensors can be, without limitation, temperature sensors, voltage or current sensors.

The system 400 can further include a carbon source dispenser 404. The carbon source dispenser 404 can be connected to a top portion of the melting pot 402, and it serves to introduce a carbon source into the melt. The carbon source can be, for example, without limitation, graphite, exfoliated graphite, or a nanocarbon oxide.

Once introduced in to the melt, the carbon can be mixed using a mixer 406, which can be configured to provide shear mixing for the melt by creating a vertical vortex. The vertical vortex and the shear mixing resulting from the mixer 506 creates forces into the melt that first, serve to break up the carbon source that is being introduced via the carbon source dispenser 404, and second, serve to homogenize the dispersion of the carbon into the melt, thus promoting the formation of highly ordered nanocarbon networks.

The system 400 further includes a controller 408 that serves to generate a current for energizing the melt in order to further promote the formation of the exemplary multi-phase covetics described herein. The controller 408 can be interfaced with a pair of electrodes 410 that are inserted into the melt. The electrodes 410 can be made of carbon, for example. The pair of electrodes 410 can serve as a current path to the electrical current that energizes the melt. In the exemplary process described herein, the electrical current at least 700 Amperes.

Figure 5:
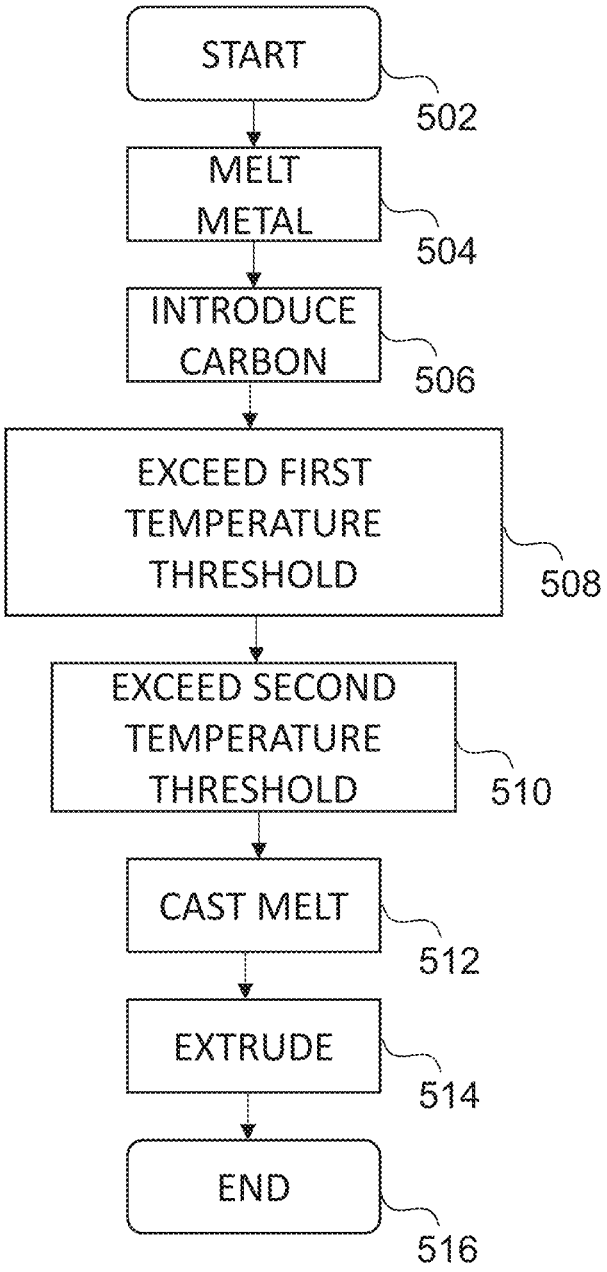
FIG. 5 depicts a flow chart of a method according to an embodiment.

FIG. 5 depicts a flow chart of a method (or process) 500 for creating making a multi-phase covetic such as the ones described herein. The method 500 can begin at block 502 and end at block 516 or at block 512 if no extrusion is desired.

The method 500 can include melting a metal by raising its temperature to its melting point (block 504). This can be achieved in a system like the system 400 described above. Once the metal is melted, carbon can be introduced into the molten metal via a carbon dispenser source (block 506). The temperature of the melt (i.e. the molten metal and the carbon included therein) can then be raised above a covetic reaction threshold to form metal-carbon sp3 bonds (block 508). In order to form highly organized nanocarbon structures, the temperature of the melt can then be increased to a critical temperature threshold that is substantially above the covetic reaction threshold (block 510). Further, at blocks 508 and 510, a current of at least 700A is applied to the melt in order to drive the reaction and promote the formation of the ordered nanocarbon structures.

The melt can then be cast and cooled to provide a solidified multi-phase covetic block (at block 512). The method 500 can then end at block 512. Alternatively, the method 500 can include an extrusion step (block 514) which can be used to further promote the segregation of the phases as shown in FIG. 2B and discussed above. The method 500 can then end at block 516.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A process for making a composite material, the process comprising:

forming a multi-phase covetic, the forming including:

heating a melt including a metal in a molten state and a carbon source to a first temperature threshold to metal-carbon bonds; and subsequently heating the melt to a second temperature threshold the second temperature threshold corresponding to a plateau in a heat profile of the melt;

wherein the second temperature threshold is greater than the first temperature threshold;

wherein the second temperature threshold is a temperature at or above which an ordered network of nanocarbons forms in the melt; and wherein electrical conductivity is increased with respect to electrical conductivity of one of the metal and carbon source material.

2. The process of claim 1, further comprising energizing the melt with an electrical current and (ii) mixing the melt using shear mixing.

3. The process of claim 2, wherein the energizing includes inserting a pair of electrodes into the melt, said pair of electrodes serving as a current path to the electrical current.

4. The process of claim 2, wherein the electrical current is at least 200 Amperes.

5. The process of claim 1, wherein the carbon source is amorphous carbon.

6. The process of claim 1, further comprising extruding the multi-phase covetic.

7. The process of claim 1, wherein the metal is a transition metal.

8. The process of claim 1, wherein the metal is aluminum and the first threshold is about 100 degrees Fahrenheit above the metal melt temperature and the second threshold is reached after full carbon addition is achieved, with the hold time being about 5 minutes.

* * * * *